US007825811B2

(12) United States Patent
Chan et al.

(10) Patent No.: US 7,825,811 B2
(45) Date of Patent: Nov. 2, 2010

(54) LOCKING SEAL WITH TAMPER INDICATION AND NOTIFICATION DEVICE

(75) Inventors: Wee Piak Chan, Singapore (SG); Tai Wee Khoo, Singapore (SG); Huan Fong Tan, Singapore (SG); Kee Fatt Chen, Singapore (SG)

(73) Assignee: Amplus Communication Pte Ltd, Singapore (SG)

( * ) Notice: Subject to any disclaimer, the term of this patent is extended or adjusted under 35 U.S.C. 154(b) by 277 days.

(21) Appl. No.: 12/096,024

(22) PCT Filed: Sep. 15, 2006

(86) PCT No.: PCT/SG2006/000270

§ 371 (c)(1),
(2), (4) Date: Jun. 4, 2008

(87) PCT Pub. No.: WO2007/067149

PCT Pub. Date: Jun. 14, 2007

(65) Prior Publication Data

US 2008/0295555 A1 Dec. 4, 2008

(30) Foreign Application Priority Data

Dec. 8, 2005 (SG) ..... 200507940-5

(51) Int. Cl.
*G08B 13/14* (2006.01)
*E05B 65/00* (2006.01)
*E05B 65/52* (2006.01)

(52) U.S. Cl. ..... 340/572.9; 70/57.1; 70/71

(58) Field of Classification Search ..... 73/761; 340/572.7–572.9, 545.2; 343/720; 70/50, 70/57.1, 71
See application file for complete search history.

(56) References Cited

U.S. PATENT DOCUMENTS

| | | | | |
|---|---|---|---|---|
| 5,005,883 | A * | 4/1991 | Guiler | 292/327 |
| 6,265,973 | B1 * | 7/2001 | Brammall et al. | 340/568.1 |
| 6,550,829 | B1 * | 4/2003 | Dobson | 292/327 |
| 6,778,083 | B2 * | 8/2004 | Auerbach et al. | 340/539.1 |
| 6,791,465 | B2 * | 9/2004 | Blagin et al. | 340/665 |
| 7,270,353 | B2 * | 9/2007 | Sironi et al. | 292/307 R |
| 7,597,253 | B2 * | 10/2009 | Lin et al. | 235/382 |
| 7,612,669 | B2 * | 11/2009 | Brigham | 340/568.4 |
| 7,696,886 | B2 * | 4/2010 | Lai | 340/572.7 |
| 2006/0145868 | A1 * | 7/2006 | Chen et al. | 340/572.8 |

* cited by examiner

*Primary Examiner*—Jennifer Mehmood
(74) *Attorney, Agent, or Firm*—Pyprus Pte Ltd

(57) ABSTRACT

A locking device comprising a lock body having a through hole, a bolt member having a longitudinal bore therethrough and an insertion end which is inserted into the through hole of the lock body. The bolt member is further having a retaining pin disposed within the longitudinal bore and a resilient means for biasing the retaining pin axially out of the longitudinal bore. When the bolt member is inserted into the lock body, a means within the lock body prevents the removal of the inserted bolt member therefrom, and engages an actuating means to actuate an identifying means. The identifying means transmits a signal to indicate whether the locking device has been tampered with or defeated. If the bolt member is cut, the retaining pin is displaced out of the longitudinal bore and dislodges the actuating means resulting in the identifying means indicating that the locking device has been tampered with or defeated.

25 Claims, 4 Drawing Sheets

LOCKING SEAL WITH TAMPER INDICATION AND NOTIFICATION DEVICE

FIELD OF THE INVENTION

The present invention relates to a locking device having features for indicating to and notifying a user whether a locking or security seal has been tampered with. In particular, the present invention relates to locking device for locking or securing ocean containers, truck trailers, freight cars, equipment cabinets, switches etc.

BACKGROUND OF THE INVENTION

Locking or security seals are used to prevent tampering with and unauthorized entry to or operation of various items. Examples of items on which locking or security seals are used are doors of ocean containers, truck trailers, freight cars, equipment cabinets, high-voltage switches etc.

A typical seal includes a metal bolt, or a flexible cable having a head on one end and a solid tip on the other end, and a lock body for receiving one end of the metal bolt or a solid tip of the flexible cable. Once the end of the metal bolt or solid tip of the flexible cable is inserted into the lock body, the metal bolt or solid tip is retained and restrained from removal by a locking mechanism in the lock body.

These seals also provide an indication of unauthorized attempts made to enter or operate an item through tampering with or defeating the seal. The indication of any tampering of the seals is normally through visual observation of the seal. However, a sophisticated interloper may easily gain entry by cutting the seal and later reposition the parts back in such a way to make it appear that the seal has not been tampered with. Visually observing the seal thus will fail to indicate the tampering of the seal.

In the U.S. Pat. No. 5,127,687 referred to in FIG. 1, a tamper indicating seal 10 of the type having a bolt 14 retained in a lock body 16 is shown. The lock body 16 is surrounded by a shroud 50 of frangible, brittle material and provided with a grooved outer surface 60 and flanged entrance way 57 for receiving and surrounding the bolt end 18*b*, whereby the shroud 50 is easily fractured, thus providing visual indication of tampering.

Any attempt to drive the lock body 16 and a fragment of the shaft 18 out of the bore 54 of the lock body 16 is prevented by interference between shoulders 57*c*, 18*c*. A further determined attempt will fracture or crack the shroud 50 or flange 57.

Due to the nature of the material of the shroud 50, breakage or chipping may occur from mishandling of the seal 10 instead of unauthorized tampering. Furthermore, a sophisticated interloper is able to cut the bolt 14 and weld the metal bolt 14 back without causing any breakage to the shroud 50. Visual inspection or observation may not be able to indicate any tampering since the shroud 50 is intact.

Therefore, there is a need for an improvement on tamper indicating device that is able to better indicate any tampering of the seal despite sophisticated interloper's attempts to undo any indication of tampering as cited above.

SUMMARY OF THE INVENTION

The present invention is a locking device comprises:

a lock body having a through hole, the through hole having a first end and a second end;

a bolt member having a longitudinal bore therethrough and an insertion end which is inserted into the through hole of the lock body;

an identifying means for transmitting a signal to indicate whether the locking device has been tampered with or defeated;

an actuating means for actuating the identifying means when the bolt member is inserted into and secured within the through hole and when the locking device has been tampered with or defeated; and a means within the lock body for preventing removal of the inserted bolt member therefrom.

Accordingly, in one aspect, the present invention provides a method of indicating whether a locking device has been tampered with or defeated, the method comprising:

providing a device comprising:

a lock body having a through hole, the through hole having a first end and a second end;

a bolt member having a longitudinal bore therethrough and an insertion end which is inserted into the through hole of the lock body;

an identifying means for indicating whether the locking device has been tampered with or defeated;

an actuating means for actuating the identifying means deactivating the identifying means; and a means within the lock body for preventing removal of the inserted bolt member therefrom.

BRIEF DESCRIPTION OF THE DRAWINGS

A preferred embodiment of the present invention will now be more fully described, by way of example, with reference to the drawings of which.

DETAILED DESCRIPTION OF THE DRAWINGS

A preferred embodiment of the invention is described. In the following description, details are provided to describe the preferred embodiment. It shall be apparent to one skilled in the art, however, that the invention may be practiced without such details. Some of these details may not be described at length so as not to obscure the invention.

The method and device in accordance with the present invention is able to indicate any tampering to the device when the bolt is cut. Furthermore, the device is able to communicate with a receiving party by notifying the party via Radio Frequency Identification (RFID) of any attempts of tampering or violating the device.

Figure 1:
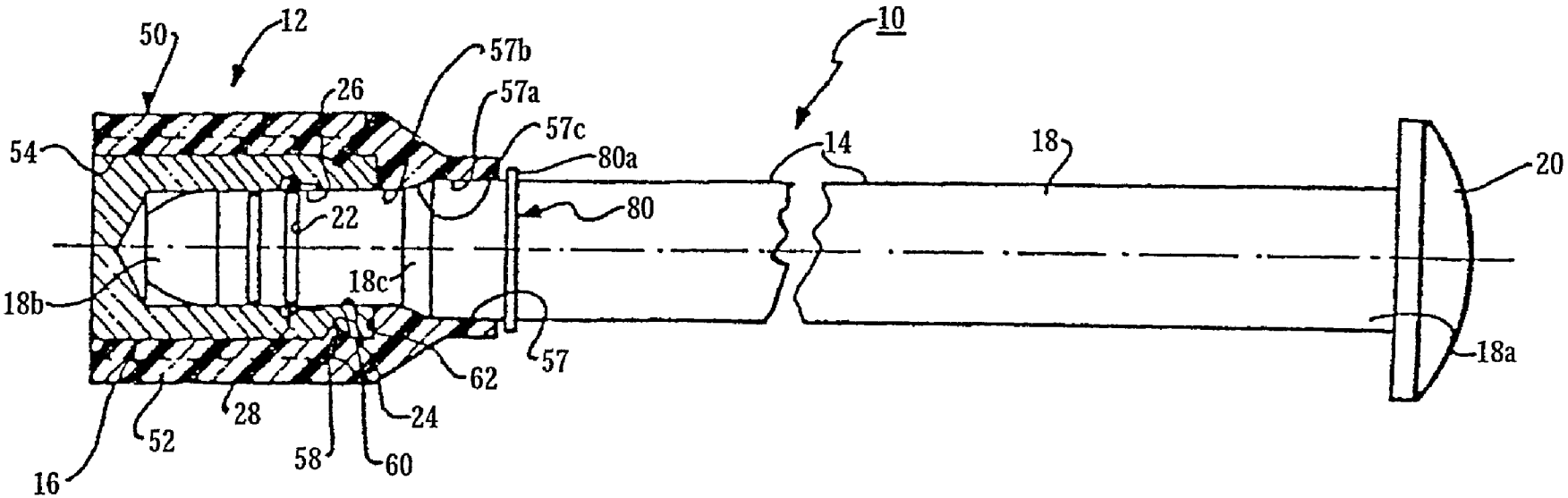
FIG. 1 (PRIOR ART)
FIG. 1 shows a tamper indicating seal of prior art U.S. Pat. No. 5,127,687.
Figure 2:
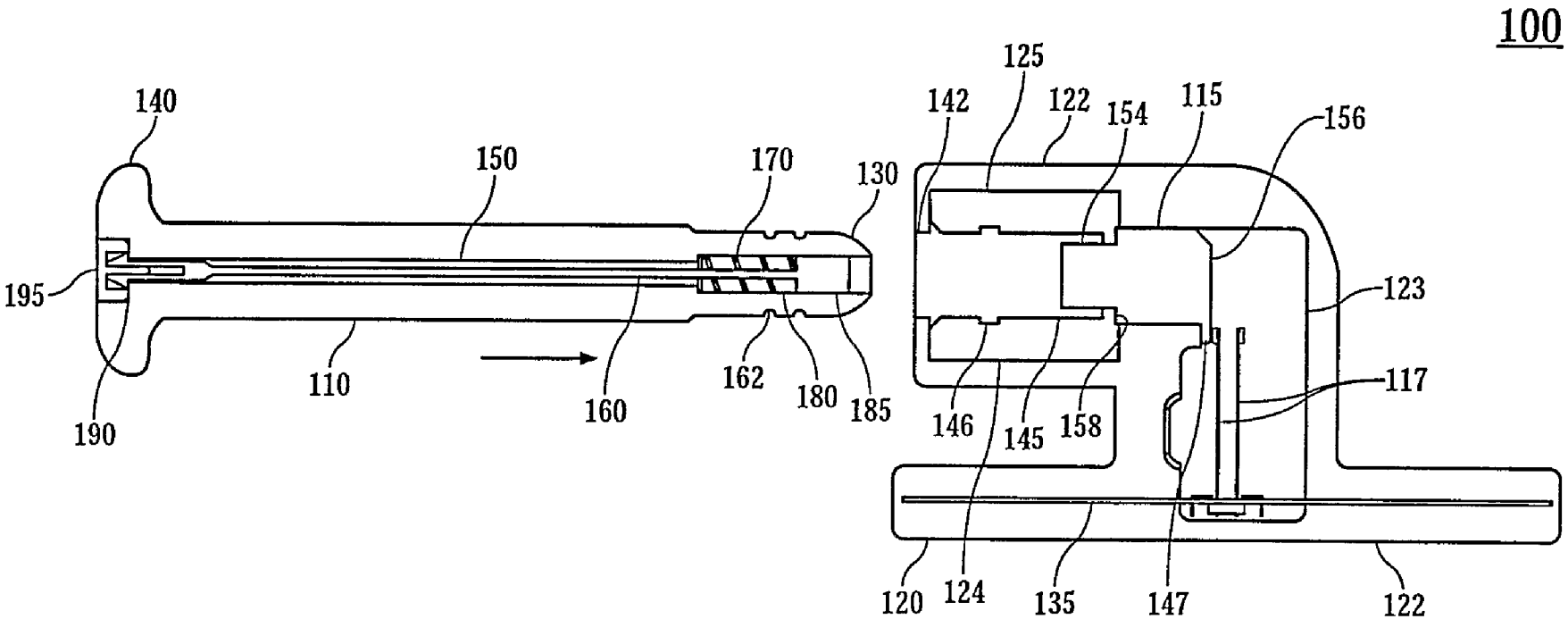
FIG. 2 illustrates a cross sectional view of the device in accordance with the present invention in an unlocked position.

Referring to FIG. 2, a cross sectional view of a device 100 in accordance with the present invention in an unlocked position is shown. The device 100 comprises a bolt member 110 having a headed end 140 and an insertion end 130, and a receiving member 120 for receiving the insertion end 130 of the bolt member 110. The bolt member 110 comprises an elongated shaft carrying an enlarged metal head at the headed end 140. The insert end 130 of the bolt member 110 has a plurality of circumferential grooves 162 formed thereon.

The bolt member 110 also has a longitudinal bore 150 therethrough and a retaining pin 160 disposed longitudinally within the longitudinal bore 150. The longitudinal bore 150 has a first end 180 and a second end 190, which communicate with the insertion end 130 and the headed end 140 of the bolt member 110 respectively. A resilient means 170 is disposed within the longitudinal bore 150 for biasing the retaining pin 160 axially out of the longitudinal bore 150. In the embodiment shown, the resilient means 170 is disposed at the first end 180 of the longitudinal bore 150. The resilient means can be a helical spring.

The retaining pin 160 comprises a terminal end 195 disposed at the second end 190 of the longitudinal bore 150 and an engagement end 185 disposed at the first end of the longitudinal bore 150. The terminal end 195 prevents the retaining pin 160 from being displaced out of the longitudinal bore 150 through the first end 180. In the event that the retaining pin 160 breaks at a region between its both ends, the retaining pin 160 will be displaced out of the longitudinal bore 150 through the first end 180.

The terminal end 195 is having a diameter greater than the diameter of the longitudinal bore 150 at the second end 190. As such, while the resilient means 170 is biasing the retaining pin 160 axially out of the longitudinal bore through the first end 180, the terminal end 195 prevents the axial displacement of the retaining pin 160.

The receiving member 120 comprises a housing 122 having a first cavity 124 and a second cavity 123 adjacent to the first cavity 124. The housing 122 has an inlet 142 through which the inserting end 130 of the bolt member 110 is inserted. The inlet 142 communicates with the first cavity 124. A lock body 125 for retaining the bolt member 110 is fixedly disposed within the first cavity 124. An identifying means 135 is fixedly disposed within the second cavity 123.

In the embodiment shown, the lock body 125 is a tubular metallic body having a through hole 145 along its longitudinal axis. The first end of the through hole 145 communicates with the inlet 142 of the housing 122 and the second end of the through hole 145 receives part of the actuating means 115. At least one cylindrical groove 146 is formed on the through hole 145. The diameter of insertion end 130 of the bolt member 110 corresponds with the diameter of the inlet 142 of the housing and the diameter of the through hole 145.

A locking, C or spring ring is placed in either the circumferential groove 162 of the bolt member 110 or the cylindrical groove 146 of the through hole 145. Upon insertion of the insertion end 130 of the bolt member 110 into the through hole 145, the ring is seated (not shown in FIG. 2 but in FIG. 3) in both the circumferential groove 162 and the cylindrical groove 146, thereby preventing the withdrawal of the bolt member 110 out of the lock body 125.

In the embodiment shown, the identifying means 135 is a passive Radio Frequency Identification (RFID) tag or transponder. The RFID tag receives and responds to radio frequency queries from an RFID transceiver (not shown in drawings). The passive RFID tag requires no internal power source. The identifying means 135 can also be an active RFID tag that is able to transmit a signal to a transceiver in the event that an attempt to violate the device is detected.

Figure 3:
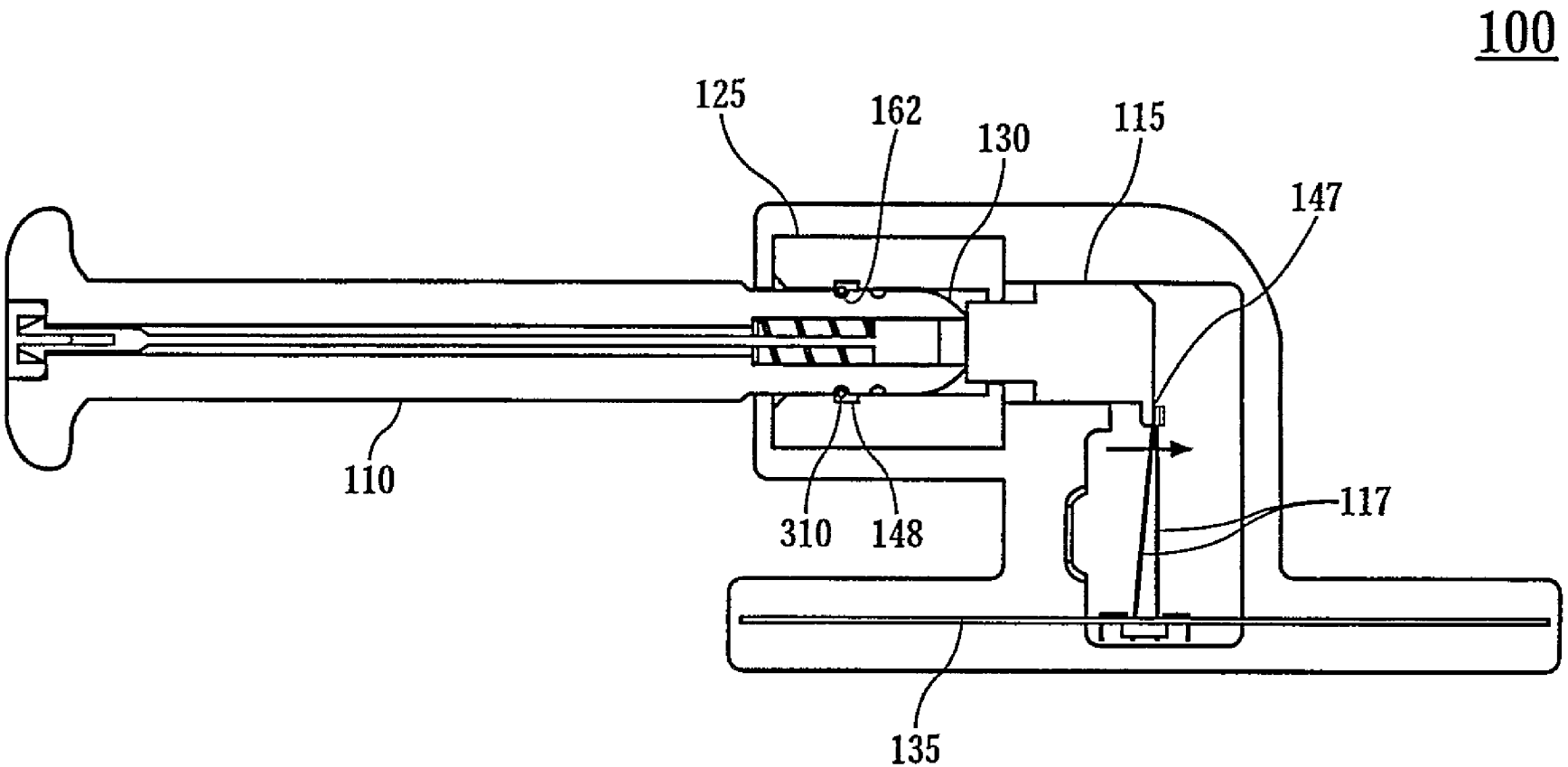
FIG. 3 illustrates a cross sectional view of the device in accordance with the present invention in a locked position.

In a preferred embodiment shown in FIG. 2 and FIG. 3, the passive RFID tag 135 has a pair of contacts 117, which when in contact with each other, indicating to a transceiver (not shown in drawings) that the device 100 is in a locked position. When the pair of contacts 117 is not in contact with each other, no signal will be received by the transceiver, thereby indicating that the device 100 is in an unlocked position or that the device 100 has been tampered with or defeated.

In the unlocked position according to FIG. 2, the actuating means 115 has a first portion 154 slidably disposed within the through hole 145 of the lock body 125 and a second portion 156 having a flange 147 out of the lock body 125. The diameter of the first portion 154 is smaller than the diameter of the second portion 156, thereby creating a circumferential step 158 between both portions. The circumferential step 158 prevents the second portion 156 of the actuating means 115 from being displaced into the lock body 125. The flange 147 is in contact with one of a pair of contacts 117 of the identifying means 135. The second portion 156 of the actuating means 115 is slidably disposed within the second cavity 123 in the unlocked position.

One of the contacts 117 that is in contact with the flange 147 retains the actuating means 115 in its unlocked position, thereby retaining the first end 154 of the actuating means 115 within the through hole 145 and preventing the actuating means 115 from sliding out of the through hole 145. The pair of contacts 117 is flexible and made of electrically conducting materials. In the unlocked position, the pair of contacts 117 are parallel to each other and do not come into contact with each other.

When a transceiver is placed within a predetermined distance from the device 100, no signal from the identifying means 135 is received by the transceiver, thereby indicating that the device 100 is in an unlocked position.

To lock the device 100, the inserting end 130 of the bolt member 110 is inserted into the lock body 125 through the inlet 142. Referring to FIG. 3, a cross sectional view of the device 100 in accordance with the present invention in a locked position is shown.

In the embodiment shown, a locking, C or spring ring 310 is seated in both the circumferential groove 162 and the cylindrical groove 146, thereby preventing the withdrawal of the bolt member 110 out of the lock body 125. The diameter of the inserting end 130 of the bolt member 110 being smaller than the longitudinal diameter of the bolt member 110 prevents the bolt member 110 from being inserted entirely into the lock body 125.

As the bolt member 110 is inserted into the lock body 125, the inserting end 130 of the bolt member 110 comes into contact with the first portion 154 of the actuating means 115. The actuating means 115 is also pushed for a predetermined distance by the inserting end 130 of the bolt member 110, such that the flange 147 actuates the pair of contacts 117 by bending one of the contacts 117 to come into contact with the other contact 117.

As the bolt member 110 remains retained or locked within the lock body 125, the pair of contacts 117 remains in contact, indicating that the device 100 is in the locked position. When a transceiver is placed within a predetermined distance from the device 100, a positive signal from the actuated identifying means 135 is received by the transceiver to indicate that the device 100 is in the locked position.

Figure 4:
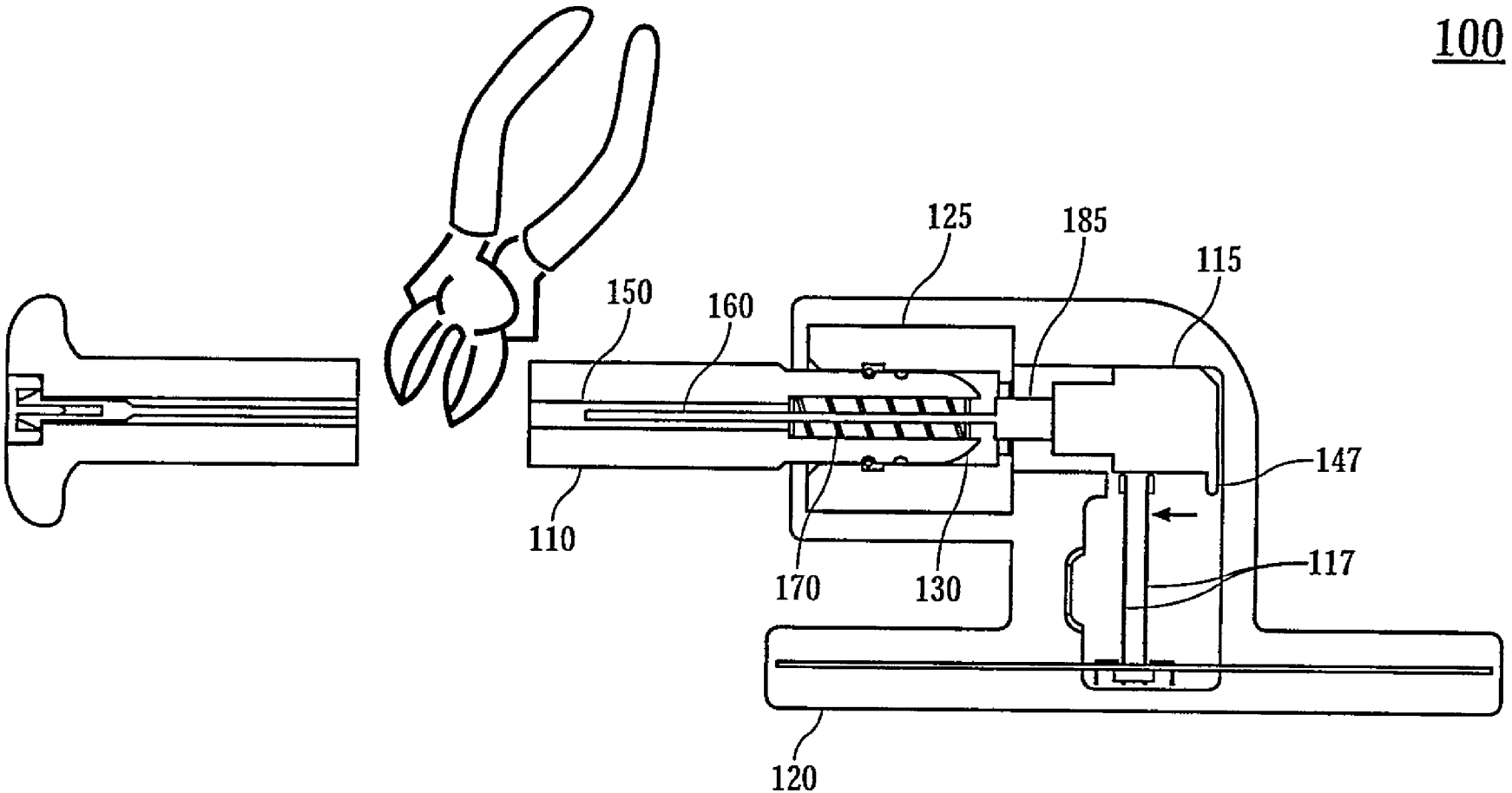
FIG. 4 illustrates a cross sectional view of the device in accordance with the present invention when the device is tampered.

Referring to FIG. 4, a cross sectional view of the device 100 is shown in accordance with the present invention when the locked device 100 is tampered or defeated. In FIG. 4, as the bolt member 110 is cut at the region out of the lock body 125, the retaining pin 160 within the bolt member 100 is also cut. The resilient means 170 thus biases the retaining pin 160 axially out of the longitudinal bore 150, thereby dislodging the actuating means 115.

The engagement end 185 of the retaining pin 160 pushes the actuating means 115 and dislodges the actuating means 115 from its locked position. The actuating means 115 therefore deactivates the identifying means 135. The flange 147 of the actuating means 115 thus stops acting on one of the contacts 117, which was initially in contact with each other in the locked position. The pair of contacts 117 returns to its original parallel form and loses contact with each other, thereby resulting in the identifying means 135 indicating that the device 100 is in an unlocked position.

The identifying means 135 indicates that the device is in an unlocked position although the insertion end 130 of the bolt member 110 retaining within the receiving member 120 indicates otherwise. When a transceiver is placed within a predetermined distance from the device 100, no signal will be received to the transceiver. If the transceiver is not receiving any signal and the insertion end 130 of the bolt member 110 is retained within the lock body 125, it is determined that the device 100 has been tampered with or defeated.

For an identifying means 135 that is an active RFID tag, a positive signal is transmitted to a transceiver to indicate that a violation of the device is detected.

It will be appreciated that although one preferred embodiment has been described in detail, various modifications and improvements can be made by a person skilled in the art without departing from the scope of the present invention.

The invention claimed is:

1. A locking device comprises:

a lock body having a through hole, the through hole having a first end and a second end;

a bolt member having a longitudinal bore therethrough and an insertion end which is inserted into the through hole of the lock body; an engagement end emerges out of said longitudinal bore at said insertion end when said bolt member is broken or cut;

an identifying means disposed near the second end of said through hole, which indicates wirelessly or contactlessly whether the locking device has been tampered with or defeated;

an actuating means disposed at the second end of said through hole, which actuates the identifying means when the bolt member is inserted into and secured within the through hole and when the locking device has been tampered with or defeated; and a means within the lock body for preventing removal of the inserted bolt member therefrom.

2. The device of claim 1, wherein the bolt member is further having a retaining pin with an engagement end disposed within the longitudinal bore and a resilient means for biasing the retaining pin axially out of the longitudinal bore.

3. The device of claim 1, wherein the device further comprises a receiving member having a housing, the housing having an inlet which communicates with the first end of the through hole.

4. The device of claim 3, wherein the housing is having a first cavity; and a second cavity adjacent to the first cavity.

5. The device of claim 4, wherein the lock body for retaining the bolt member is fixedly disposed within the first cavity.

6. The device of claim 4, wherein the identifying means is disposed within the second cavity.

7. The device of claim 4, wherein part of the actuating means is received into the second end of the through hole.

8. The device of claim 1, wherein the identifying means comprises a pair of contacts.

9. The device of claim 8, wherein the actuating means is having a flange in contact with one of the pair of contacts when the locking device has not been tampered with.

10. The device of claim 9, wherein the insertion end of the bolt member comes into contact with the actuating means and pushes the actuating means for a predetermined distance such that the flange actuates the pair of contacts by bending one of the pair of contacts to come into contact with the other one of the pair of contacts, when the device is in a locked position.

11. The device of claim 9, wherein the engagement end of the retaining pin in the bolt member is displaced by the resilient means, when the bolt member is broken or cut, to dislodge the actuating means from its locked position, thereby the flange of said actuating means stays out of contact with any one of the pair of contacts and hence the pair of contacts is not in contact with each other.

12. The device of claim 10, wherein a positive signal from the identifying means is received by a transceiver when said transceiver transmits a predetermined signal to said identifying means and when the pair of contacts is in contact with each other, the positive signal indicating that the device is in a locked position.

13. The device of claim 11, wherein no signal from the identifying means is received by a transceiver when said transceiver transmits a predetermined signal to said identifying means and when the pair of contacts is not in contact with each other.

14. The device of claim 8, wherein the pair of contacts is not in contact with each other when the insertion end of the bolt member has not been inserted into the lock body of the device.

15. The device of claim 14, wherein the pair of contacts is made of flexible and electrically conducting materials.

16. The device of claim 1, wherein the identifying means is a Radio Frequency Identification (RFID) tag or transponder.

17. The device of claim 2, wherein the resilient means is a helical spring.

18. A method of indicating whether a locking device has been tampered with or defeated, the method comprising:

providing a device comprising:

a lock body having a through hole, the through hole having a first end and a second end;

a bolt member having a longitudinal bore therethrough and an insertion end which is inserted into the through hole of the lock body; an engagement end emerges out of said longitudinal bore at said insertion end when said bolt member is broken or cut;

an identifying means disposed near the second end of said through hole, which indicates wirelessly or contactlessly whether the locking device has been tampered with or defeated;

an actuating means disposed at the second end of said through hole, which actuates the identifying means when the bolt member is inserted into and secured within the through hole and when the locking device has been tampered with or defeated; and a means within the lock body for preventing removal of the inserted bolt member therefrom.

19. The method of claim 18, wherein the method further comprising providing a retaining pin with an engagement end disposed within the longitudinal bore and a resilient means for biasing the retaining pin axially out of the longitudinal bore.

20. The method of claim 18, wherein the method further comprising inserting the bolt member into the lock body, thereby actuating the identifying means.

21. The method of claim 20, wherein the method further comprising activating a transceiver to transmit a predetermined signal to said identifying means for indication of the device having been tampered with or defeated.

22. The method of claim 21, wherein the method further comprising the transceiver receiving a positive signal from the identifying means, the positive signal indicating that the device is in a locked position.

23. The method of claim 21, wherein the method further comprising the transceiver not receiving a signal from the identifying means, indicating that the device is in an unlocked position or the device has been tampered with or defeated.

24. The method of claim 23, wherein the method further comprising determining that the device has been tampered with or defeated when the identifying means indicates that the device is in an unlocked position and the insertion end of the bolt member is retained within the lock body.

25. The method of claim 19, wherein the resilient means biases the retaining pin axially out of the longitudinal bore, thereby dislodging the actuating means and deactivating the identifying means, when the bolt member and the retaining pin are cut.

* * * * *